US006036487A

United States Patent [19]

Westerman

[11] Patent Number: 6,036,487

[45] **Date of Patent: *Mar. 14, 2000**

[54] MOUTHGUARD BLANK AND MOUTHGUARD

[75] Inventor: Bill Westerman, Clayfield, Australia

[73] Assignee: Fastcote Pty Ltd., Queensland, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/704,636

[22] PCT Filed: Feb. 22, 1995

[86] PCT No.: PCT/AU95/00083

§ 371 Date: Aug. 23, 1996

§ 102(e) Date: Aug. 23, 1996

[87] PCT Pub. No.: WO95/23013

PCT Pub. Date: Aug. 31, 1995

[30] Foreign Application Priority Data

Feb. 23, 1994 [AU] Australia ..... PM 4055

[51] Int. Cl.[7] ..... A61C 3/00

[52] U.S. Cl. ..... 433/6; 128/861; 128/862

[58] Field of Search ..... 433/6, 93, 140; 128/859, 861, 862

[56] References Cited

U.S. PATENT DOCUMENTS

| | | | |
|---|---|---|---|
| 3,207,153 | 9/1965 | Goldstein . | |
| 3,247,844 | 4/1966 | Berghash . | |
| 3,319,626 | 5/1967 | Lindsay . | |
| 3,527,219 | 9/1970 | Greenberg | 128/861 |
| 3,532,091 | 10/1970 | Lerman | 128/862 |
| 3,722,101 | 3/1973 | Via, Jr. | 433/140 |
| 3,844,286 | 10/1974 | Cowen | 128/861 |
| 3,971,370 | 7/1976 | Halford et al. | 128/861 |
| 4,920,984 | 5/1990 | Furumichi et al. | 433/6 |
| 4,955,393 | 9/1990 | Adell | 128/862 |
| 5,082,007 | 1/1992 | Adell . | |
| 5,235,991 | 8/1993 | Minneman | 128/861 |
| 5,293,880 | 3/1994 | Levitt | 128/861 |
| 5,323,787 | 6/1994 | Pratt | 128/862 |
| 5,406,962 | 4/1995 | Adell | 128/861 |

FOREIGN PATENT DOCUMENTS

| | | |
|---|---|---|
| 2024799 | 9/1990 | Canada . |
| 490137 | 6/1992 | European Pat. Off. . |
| 2576798 | 8/1986 | France . |
| 3-244480 | 10/1991 | Japan . |
| 4-28381 | 1/1992 | Japan . |
| 5-0300915 | 11/1993 | Japan . |
| 5-300915 | 11/1993 | Japan . |

OTHER PUBLICATIONS

Abstract, SE8404–661–A, Peter Wallner, et al., Swedish Patent Application filed Mar. 17, 1985.

*Primary Examiner*—Ralph A. Lewis
*Attorney, Agent, or Firm*—Knobbe, Martens, Olson & Bear LLP

[57] ABSTRACT

A mouthguard (15) made from an orally acceptable plastics material. The mouthguard has a plurality of enclosed cavities (11) as spaced locations arranged in at least a substantial part of the mouthguard.

26 Claims, 5 Drawing Sheets

MOUTHGUARD BLANK AND MOUTHGUARD

FIELD OF THE INVENTION

THIS INVENTION relates to an improved material for mouthguards and to a mouthguard made from that material.

BACKGROUND OF THE INVENTION

The invention will be described by way of example with reference to mouthguards intended to be used while taking part in body contact sports. It should be appreciated that this is by way of example only and that the mouthguard of the invention may be used for therapeutic purposes also. For example the mouthguard may be used for treating temporomandibular disorders or the like.

DISCLOSURE OF THE INVENTION

Mouthguards are typically made from plastics material such as an ethylene vinyl acetate copolymer (EVA) and fall into three specific categories. The mouthguards are either stock products premoulded and made in a variety of sizes, home or self mouldable to suit the physical characteristics of the user or custom moulded to suit the characteristics of the user. The stock mouthguards are typically the cheapest and least effective in use while the custom moulded and shaped mouthguards are the most expensive and effective in their impact absorbent properties.

Little has been done to improve upon the characteristics and properties of mouthguards to enhance their effectiveness in protecting the teeth, jawbone and intraoral tissues from injury while the wearer takes part in body contact sporting activities such as boxing, football and the like.

German patent specification 4011204 discloses a mouthguard material consisting of an EVA copolymer material, polycaprolactone and colorants and perfumes and PVA to reduce the softening point of the resultant mouthguard for ease of manipulation and shaping.

U.S. Pat. No. 4,920,984 relates to a mouthguard material which may be custom shaped or moulded employing a teeth impression cast pressed against softened thermoplastic sheet material which increases in thickness from one end to the other.

Australian patent specification 633269 discloses a mouthguard made from an EVA copolymer having a softening point higher than the normal temperature of an oral cavity but lower than the highest temperature that the oral cavity can endure so that the user may adapt the mouthguard to fit the mouth by biting onto it after it has been heated. The shaping procedure may be repeated if the shape or configuration of the teeth should change.

Earlier proposals as well as providing materials enabling custom or self shaping of the mouthguard have also suggested the use of other additives to the material of construction to enhance the characteristics of the material. For example, U.S. Pat. No. 4,044,762 suggested the inclusion of not greater than 5% sodium fluoride, stannous fluoride or sodium fluorosilicate in the material of construction to simultaneously provide prophylactic treatment of the teeth.

There has been little activity in the construction of mouthguards in an attempt at enhancing the impact absorption properties other than the change in thickness referred to in U.S. Pat. No. 4,920,984.

It is an object of the invention to provide an improved mouthguard material and a mouthguard made from that material which provides enhanced impact absorbent properties.

According to one aspect, the invention provides a mouthguard material made of orally acceptable plastics material, the mouthguard material having a plurality of enclosed cavities therein at spaced locations arranged in at least a substantial part of the material.

The enclosed cavities may be of any suitable size and shape. For example, the cavities may have irregular shapes or regular shapes such as spherical or cylindrical shapes. The cavities need not be regularly spaced. For example, the cavities may occur randomly spaced throughout the material. The cavities in the material need not all be the same size or shape. However, it is preferred that the cavities employed in the material all be similar in size and shape.

The enclosed cavities may be present as voids in the material. If desired, the cavities may be filled with gas or liquid to enhance the impact absorption characteristics of the material. In one embodiment, the cavities may be filled with a synthetic material different from the substance from which the mouthguard material is predominantly made.

It is preferred that the mouthguard material be made from an ethylene vinyl acetate copolymer (EVA) substitute or equivalent. Additives may be added to the EVA to provide special properties for the mouthguard material. Preferably a copolymer of ethylene and about 20% by weight vinyl acetate is employed. Colorants, perfumes and softening agents may also be added.

According to another aspect, the invention provides a mouthguard made of orally acceptable plastics material and having a plurality of enclosed cavities therein at spaced locations arranged over at least a substantial part of the mouthguard.

One way in which the cavities may be formed is by employing an inner layer of sheet material in which a plurality of spaced apertures are formed and an upper and a lower layer of sheet material bonded to opposed sides of the inner layer to thereby close off the apertures to form the enclosed cavities. Other ways of forming the cavities may also be employed.

DISCLOSURE OF THE DRAWINGS

Preferred aspects -of the invention are described with reference to the drawings in which.

DETAILED DESCRIPTION OF THE DRAWINGS

Figure 1:
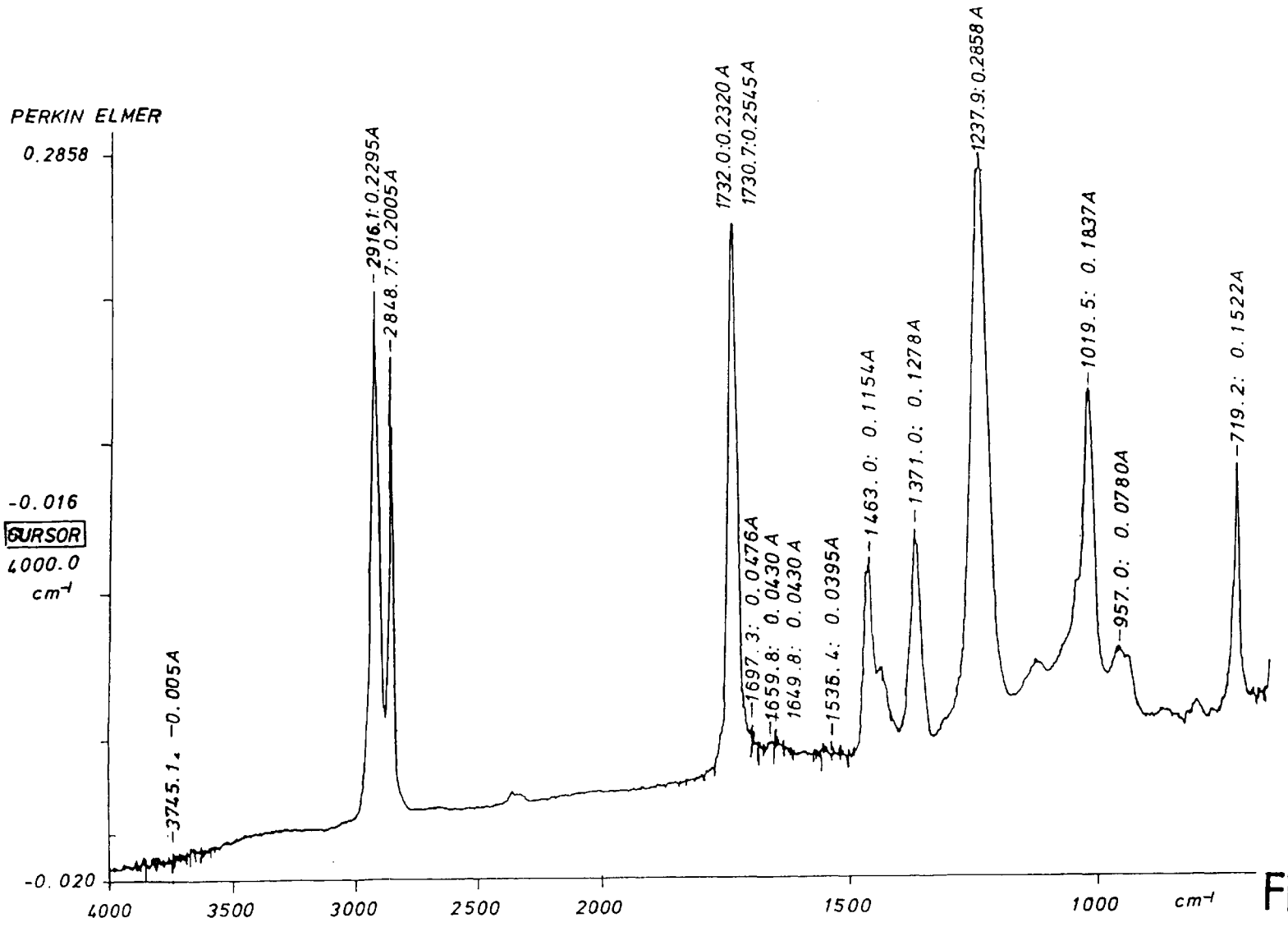
FIG. 1 is a spectral analysis of a preferred material from which the mouthguard of the invention may be made.
Figure 6:
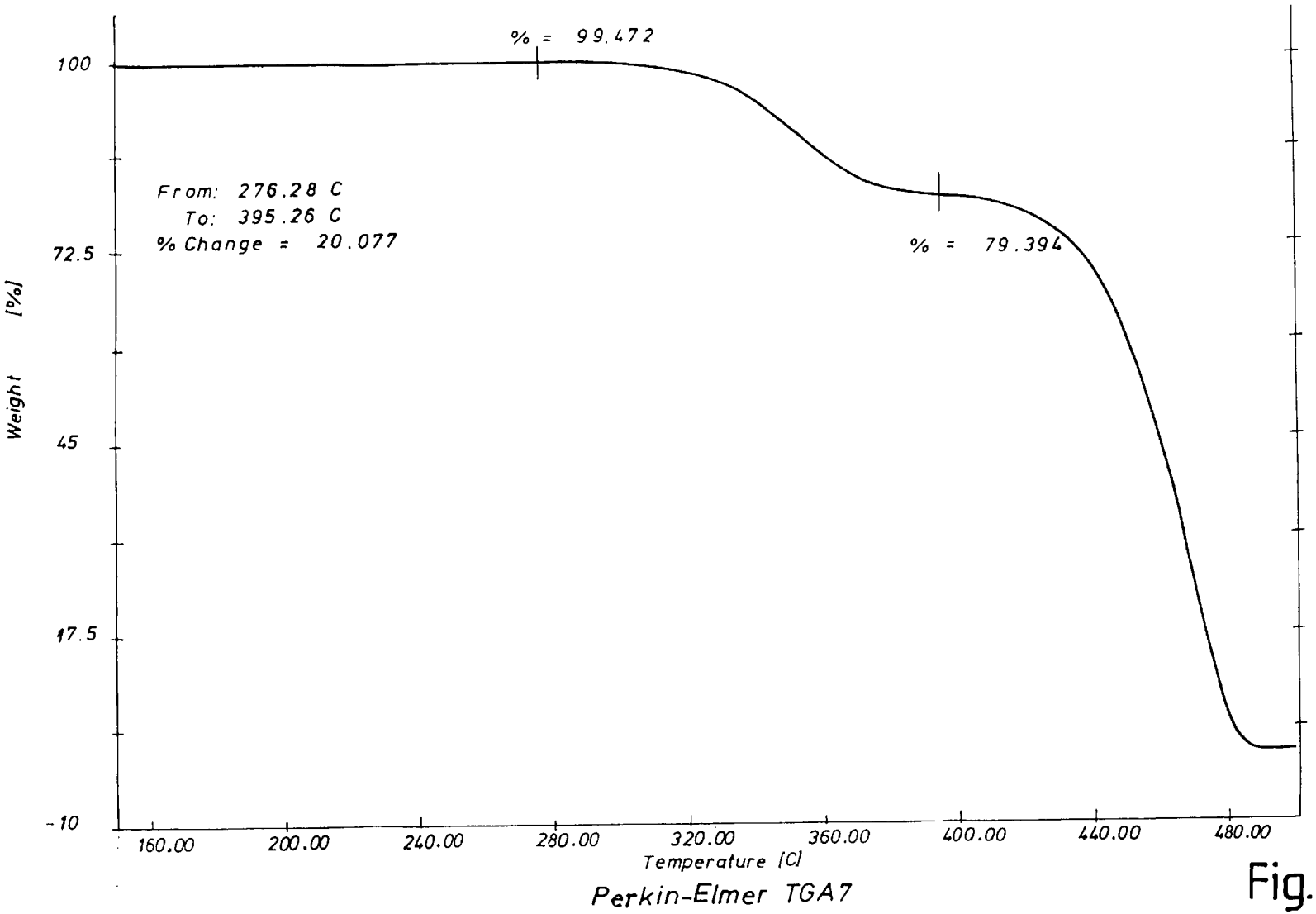
FIG. 6 is a graph of a thermal gravimetric analysis of the material identified by FIG. 1.

FIG. 1 is a Perkin-Elmer spectral trace which identifies the preferred material from which mouthguards according to the invention may be made. The material is sold under the trade mark STAY-GUARD and is made by World Wide Dental Inc in Clearwater, Fla., United States of America. FIG. 6 shows a graph of a thermal gravimetric analysis of this material. The material is an ethylene vinyl acetate copolymer with 20% by weight vinyl acetate.

The mouthguard may be pre-moulded and thus be of the more basic type of mouthguard previously mentioned. Alternatively the mouthguard may be user mouldable to suit the physical characteristics of the user. In yet another alternative, the mouthguard material of the invention may be custom moulded using a cast or impression taken of the user's physical characteristics.

Figure 2:
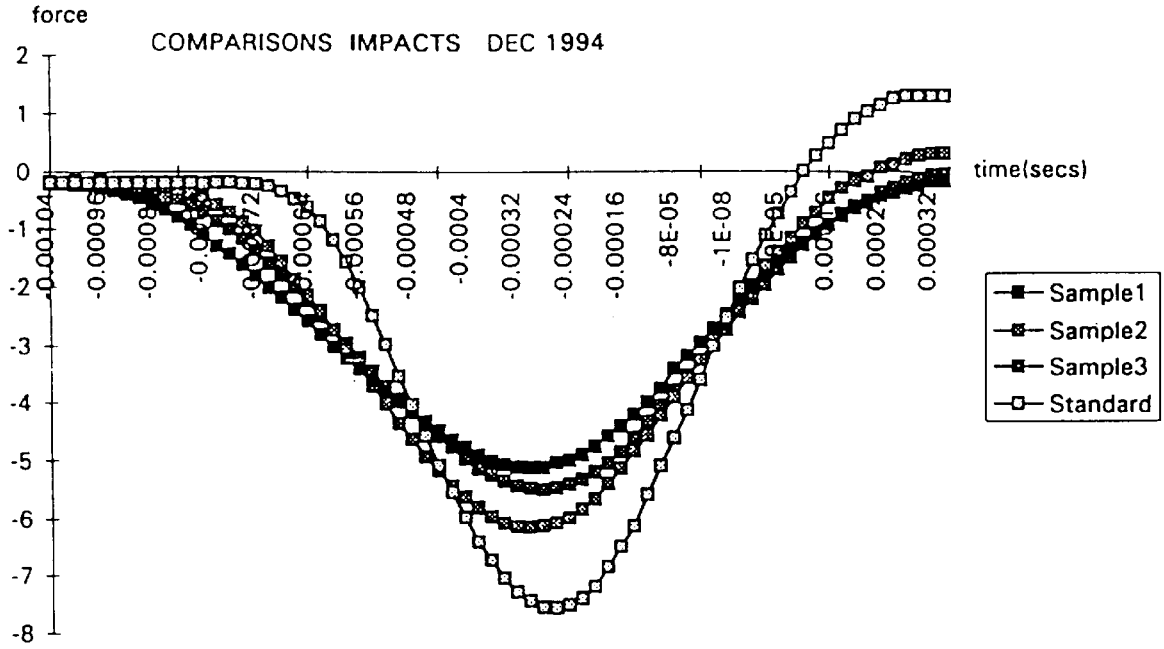
FIG. 2 is a graph showing comparative test results for materials from which mouthguards according to the invention may be made and standard mouthguard material.

FIG. 2 is a graph showing impact results for the preferred EVA material identified by the spectral analysis shown in FIG. 1 but not having voids or cavities in accordance with the invention. The sample identified as standard is such an EVA material.

Sample 1 is made from the same EVA material but has enclosed cavities formed in it. The cavities have a size of 2×2 mm and are separated by 2 mm wide borders. Sample 2 once again is made of the preferred EVA material and the cavities are 2×2 mm in size and separated by 1.00 mm borders. Sample 3 is made from the preferred EVA material and has cavities 3×3 mm in size separated by 1 mm borders.

The samples tested had a nominal thickness of about 4 mm and were all of the same dimensions. A minimal wall thickness may be provided on opposite side faces of the material overlying the cavities. A known force was applied to each of the sample materials and the force transmitted through the samples is shown in the graph. Sample 3 provided the greatest impact absorbing properties.

Figure 3:
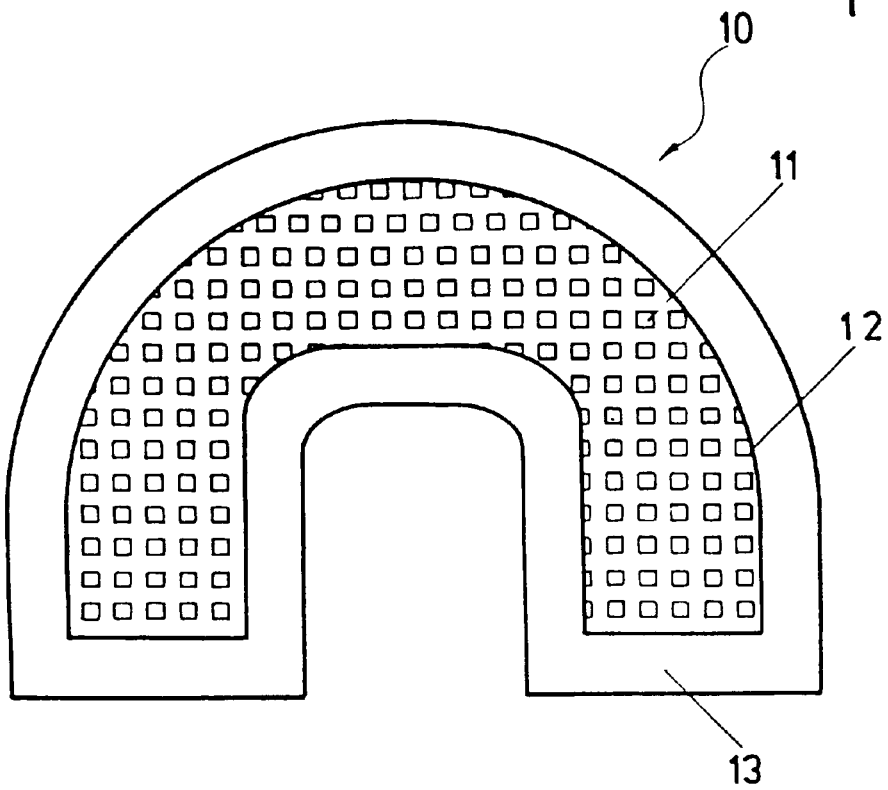
FIG. 3 is a plan view of a blank of material from which a mouthguard in accordance with the invention may be made.

FIG. 3 shows a blank of material from which a mouthguard in accordance with the invention may be made. The blank 10 is in the general shape necessary for a mouthguard and may either be premoulded into standard sizes or softened and moulded to conform to the shape required by a user.

Not all of the blank 10 is provided with enclosed cavities shown generally by the numeral 11. These cavities 11 are confined within a border 12 such that when moulded the area defined by the border 12 extends over the ends of the teeth of the user and substantially over both sides of the teeth. A peripheral zone 13 is free of cavities.

Figure 4:
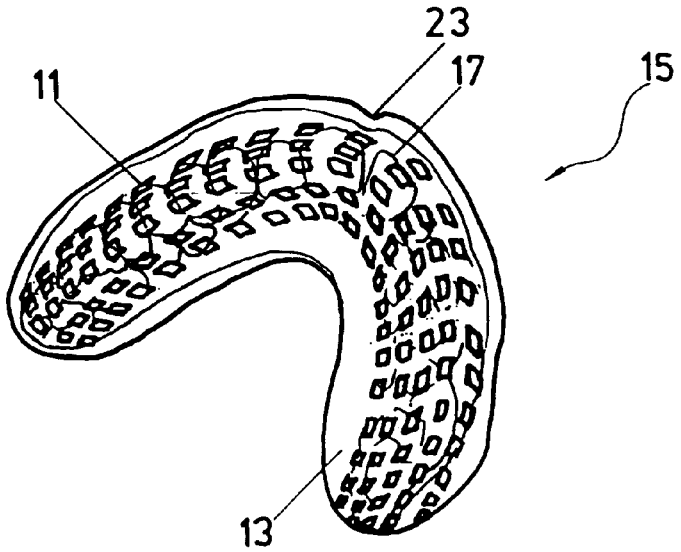
FIG. 4 shows a perspective view of a mouthguard made from the blank of FIG. 3.

FIG. 4 is a perspective view of a mouthguard 15 made from the blank like that of FIG. 3. The mouthguard has an occlusal zone against which the teeth may bite, and outer or buccal wall and an inner or lingual wall. The view shown is above looking into the valley within which teeth are received by the mouthguard. The cast 16 shown in FIG. 5 has been used as a mould for forming the mouthguard 15 and depressions 17 into which teeth project area clearly visible. Portions of the zone 13 may be trimmed away as required or deemed necessary.

Figure 5:
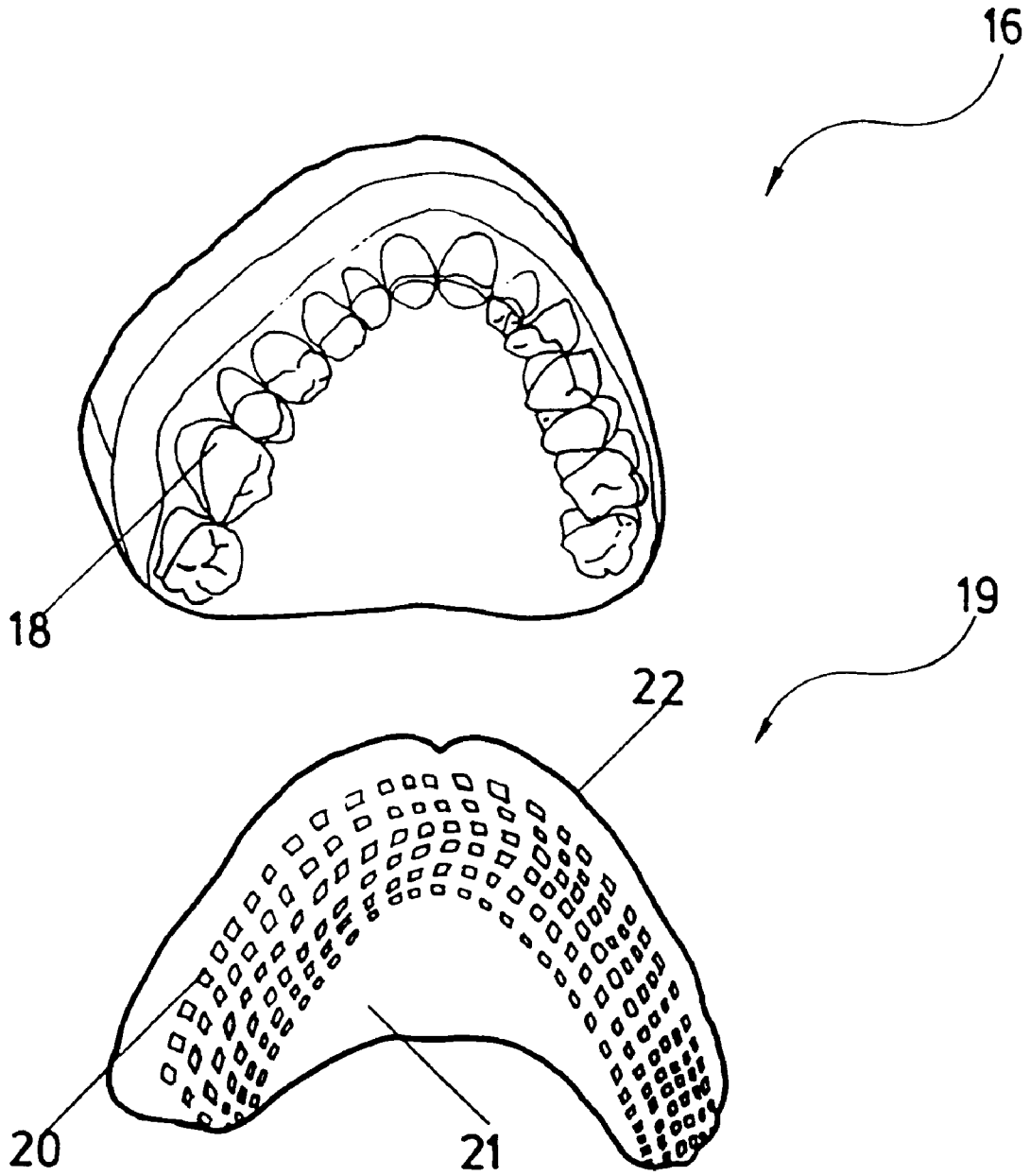
FIG. 5 is an exploded perspective view of a cast and the mouthguard shown in FIG. 4.

FIG. 5 shows a view of a cast on which a mouthguard may be formed. The cast 16 is representative of an upper set of teeth 18. A blank of material in accordance with the invention is moulded into a mouthguard 19. Enclosed cavities 20 extend over a portion of the guard 19 and at least cover or extend over the teeth when in use. In this embodiment the cavities extend in rows and columns over the occlusal zone and in rows and columns part way over the lingual and buccal walls. A palate portion 21 shown in this figure is trimmed in the finished mouthguard 15 shown in FIG. 4. Likewise the free edge 22 may be trimmed to suit to provide a recess 23 (see FIG. 4) to accommodate the frenum on the inner surface of the upper lip of the wearer of the guard.

I claim:

1. A mouthguard blank made of a non-foam, orally acceptable plastics material, the blank having a plurality of spaced, enclosed and airtight cavities smaller than a tooth and completely within the material from which the blank is made and within that part of the blank which provides an occlusal zone in a mouthguard formed from the blank and within at least that part of the blank which provides a lingual wall and a buccal wall in the mouthguard formed from the blank, wherein the mouthguard formed from the blank extends completely along all of the teeth in either a top or a bottom arch and the walls are adapted to contact the teeth.

2. The mouthguard blank of claim 1, wherein the cavities are regularly spaced.

3. The mouthguard blank of claim 1, wherein the cavities have a regular shape.

4. The mouthguard blank of claim 1, wherein the cavities are all of a similar size and shape.

5. The mouthguard blank of claim 1, wherein the mouthguard blank is made from any ethylene vinyl acetate copolymer.

6. The mouthguard blank of claim 5, wherein the ethylene vinyl acetate copolymer includes at least 20% by weight vinyl acetate.

7. The mouthguard blank of claim 1, wherein the cavities are filled either with a liquid or a gas.

8. The mouthguard blank of claim 1, wherein the cavities are filled with a synthetic material different from the orally acceptable plastics material.

9. A mouthguard for use in body contact sports made of a non-foam, orally acceptable plastics material and having an occlusal zone, a buccal wall and a lingual wall with the occlusal zone and the walls together defining a substantially U-shaped profile in transverse cross section, a plurality of spaced, enclosed cavities smaller than a tooth and completely within the material from which the mouthguard is made and within the occlusal zone and within at least part of the lingual and buccal walls wherein the mouthguard is adapted to extend completely along all of the teeth in either a top or a bottom arch and being able to contact the teeth.

10. A mouthguard blank, comprising: a blank made of a flat, non-foam, orally acceptable plastic material having a semi-circular peripheral portion terminating at opposing ends of a straight side with a cutout at the center of the straight side extending perpendicular to the straight side and extending toward the middle of the semi-circular portion at a location that corresponds to a pallet of a mouth when the blank is formed into a mouthpiece, the mouthpiece having a plurality of spaced, air-tight cavities that are smaller than a tooth and located to be positioned adjacent at least one of the sides and an occlusal zone of the teeth when the blank is formed into a mouthpiece and placed into a mouth during use.

11. A blank as defined in claim 10, wherein the recess has a square cross-section.

12. A blank as defined in claim 10, wherein the blank is made of EVA.

13. A blank as defined in claim 10, wherein the blank has a border around the periphery that has no cavities.

14. A blank as defined in claim 10, wherein the cavities are of similar size and shape.

15. A blank as defined in claim 10, wherein the cavities have a square cross-sectional shape about 3×3 mm, and are spaced apart by 1 mm borders.

16. A blank as defined in claim 10, wherein the cavities are filled with a synthetic material different from the orally acceptable plastic material.

17. A blank as defined in claim 10, wherein the blank is formed into a mouthguard having buccal and lingual walls with the cavities extending along a sufficient portion of the walls to absorb impact so the mouthguard may be used in body contact sports to reduce the impact force to teeth enclosed by the mouthguard during use.

18. A blank for a mouthguard, comprising an inner and outer layer separated by walls to form a plurality of separate, air-tight cavities between the layers, on lingual and buccal sides of the mouthguard and the intervening occlusal zone of the teeth the cavities being smaller than a person's tooth and the layers and walls being made of the same, non-foam material, the blank having a size and shape configured to form a mouthguard that abuts the lingual and buccal sides of a person's teeth during use.

19. A blank as defined in claim 18, wherein the blank is formed into a mouthguard having an occlusal zone and buccal and lingual walls forming a U-shaped cross-section, with the cavities extending along a sufficient portion of the walls to absorb impact so the mouthguard may be used in body contact sports to reduce the impact force to teeth enclosed by the mouthguard during use.

20. A blank as defined in claim 19, wherein the cavities are of similar size and shape.

21. A blank as defined in claim 10, wherein there is a border around a periphery of the blank that has no cavities.

22. A blank as defined in claim 19, wherein the cavities have a square cross-sectional shape about 3×3 mm, separated by 1 mm walls.

23. A blank as defined in claim 22, wherein the blank is formed into a mouthguard having an occlusal zone and buccal and lingual walls forming a U-shaped cross-section, with the cavities extending along a sufficient portion of the walls to absorb impact so the mouthguard may be used in body contact sports to reduce the impact force to teeth enclosed by the mouthguard during use.

24. A mouthguard for reducing impact to teeth encased by the mouthguard, the mouthguard having a U-shaped cross section with lingual and buccal walls abutting the teeth during use, the mouthguard extending from an arch of the teeth along opposing sides of the teeth on either a top or bottom of the mouth during use of the mouthguard, the mouthguard being made of an EVA, non-foam material having a plurality of air-tight cavities that are smaller than a person's tooth, the cavities being separated by cavity walls and extending along a sufficient portion of the buccal and lingual walls to reduce the impact force transmitted through the mouthguard to the teeth during use sufficient so the mouthguard may be used in body contact sports.

25. A blank as defined in claim 24, wherein the size of the cavities and a thickness of the cavity walls is selected so as to reduce the impact force transmitted through the mouthpiece to the teeth during use of the mouthpiece.

26. A blank as defined in claim 25, wherein the cavities have a square cross-sectional shape about 3×3 mm, separated by 1 mm borders.

* * * * *